US007766497B2

(12) United States Patent
Sommers et al.

(10) Patent No.: US 7,766,497 B2
(45) Date of Patent: Aug. 3, 2010

(54) COOL ENVIRONMENT LAMP WITH ANTI-FOG COMPONENT

(75) Inventors: Mathew Sommers, Sagamore Hills, OH (US); William David Sekela, Aurora, OH (US); Gerald P. O'Hara, Jr., North Canton, OH (US)

(73) Assignee: Lumination LLC, Cleveland, OH (US)

( * ) Notice: Subject to any disclaimer, the term of this patent is extended or adjusted under 35 U.S.C. 154(b) by 244 days.

(21) Appl. No.: 11/963,402

(22) Filed: Dec. 21, 2007

(65) Prior Publication Data

US 2009/0161350 A1 Jun. 25, 2009

(51) Int. Cl.
*F21V 33/00* (2006.01)

(52) U.S. Cl. ..... 362/92; 62/264; 362/311.03

(58) Field of Classification Search ..... 362/92, 362/234, 800, 257, 311.01–311.03, 509, 362/253, 317, 326, 351, 217.02; 62/264
See application file for complete search history.

(56) References Cited

U.S. PATENT DOCUMENTS 3,609,345 A * 9/1971 Perkiss ..... 362/343
3,703,636 A * 11/1972 Schmitt ..... 362/298
7,128,454 B2 * 10/2006 Kim et al. ..... 362/507
2003/0068503 A1 4/2003 Hage
2003/0137828 A1 * 7/2003 Ter-Hovhannisian ..... 362/92
2003/0205059 A1 * 11/2003 Roche et al. ..... 65/60.1
2004/0194388 A1 * 10/2004 Roche et al. ..... 49/120

FOREIGN PATENT DOCUMENTS

WO WO 01/00065 A1 1/2001

OTHER PUBLICATIONS

General Electric Company; GE Advanced Materials Specialty Film & Sheet; Lexan* HP92AF Film Product Sheet; 2004.

* cited by examiner

*Primary Examiner*—Bao Q Truong
(74) *Attorney, Agent, or Firm*—Fay Sharpe LLP

(57) ABSTRACT

A lamp that can be used in a refrigerated or cold environment where an overall light output measured on a target plane is not significantly reduced due to condensation or fog includes a housing including a translucent cover, an LED disposed in the housing, and an anti-fog film. The LED is disposed in the housing with relation to the translucent cover such that light from the LED passes through the cover. The anti-fog film is disposed on at least one of the surfaces of the translucent cover.

22 Claims, 3 Drawing Sheets

COOL ENVIRONMENT LAMP WITH ANTI-FOG COMPONENT

BACKGROUND

Commercial refrigerated display cases are typically illuminated using lamps located inside the display case. When a consumer opens a door of the refrigerated display case, warmer more humid air located outside the display case flows into the display case, which contains cooler less humid air. Condensation and fog can accumulate on the lens or translucent cover of the lamp as the warmer more humid air cools inside the display case. Until the condensation evaporates from the lens, a reduction in the overall light output measured on the products displayed in the refrigerated display case results.

At present, most commercial refrigerated display cases are illuminated using fluorescent lamps. Fluorescent tubes radiate heat as power is delivered to the lamp to illuminate the lamp. Since the fluorescent tubes are cylindrical, the heat radiates in all directions around the tube. The heat that is radiated toward the lens of the fluorescent lamp warms the lens. The warm lens can prevent fog or condensation from forming on the lens because the moisture quickly dissipates into the air of the refrigerated display case.

More recently, light emitting diode (LED) lamps have been employed to illuminate the inside of refrigerated display cases. LED lamps are preferred because they consume less power (watts) than their fluorescent counterparts, which results in an energy savings. Since less power is being delivered to the LED lamp, as compared to a fluorescent lamp, there is less heat generated by the lamp to warm the lens (or translucent cover) that covers the LEDs. Moreover, as more efficient LEDs have been developed and the systems have been improved to direct the light toward more useful areas of the display case, the amount of power that is delivered to the LED lamp is further reduced.

In addition to consuming less power, lamps that employ LEDs do not dissipate very much heat via radiation. Instead, LED lamps found in refrigerated display cases conduct heat from the non-light emitting side of the LED into a heat sink, a large portion of which is spaced from the lens or translucent cover. Accordingly, it is difficult to use the heat generated by the LEDs to dissipate any fog or condensation that forms on the lens or translucent cover of the LED lamp.

Additionally, LED lamps that are used to illuminate refrigerated display cases are also only moderately sealed. In other words, the housing of the lamp assembly allows for the ingress of air and water into the housing, which can result in condensation forming on the inner (light entering) surface of the lens or translucent cover for the LED lamp.

BRIEF DESCRIPTION

To overcome the fogging and condensation problems associated with LED lamps in cool environments, a lamp that can be used in a cool environment where an overall light output measured on a target plane is not significantly reduced due to condensation or fog includes anti-fog material disposed on at least one of the surfaces of the translucent cover of the lamp.

For example, a refrigerated display case includes a refrigerated enclosure, a door, and a lamp assembly. The enclosure includes a door opening, and the door attaches to the enclosure and covers the door opening for providing access to inside the enclosure. The lamp assembly connects to the enclosure for illuminating products stored within the enclosure. The lamp assembly includes a plurality of LEDs, a heat sink in thermal communication with the LEDs, a cover connected to the heat sink, and an anti-fog material in or on the cover. The plurality of LEDs conduct heat into the heat sink. The cover is disposed in relation to the LEDs so that light emitted from the LEDs passes through the cover. Providing the anti-fog material lessens the likelihood of fog or condensation forming on the translucent cover, which would lessen the overall light output measured on the products stored in the enclosure.

A method for manufacturing a lamp for use in a refrigerated environment includes placing an LED in a housing and attaching a cover made from sheet stock to the housing at a location so that light emitted from the LED passes through the cover. The sheet stock in this example has already been coated with an anti-fog material.

DETAILED DESCRIPTION

Figure 1:
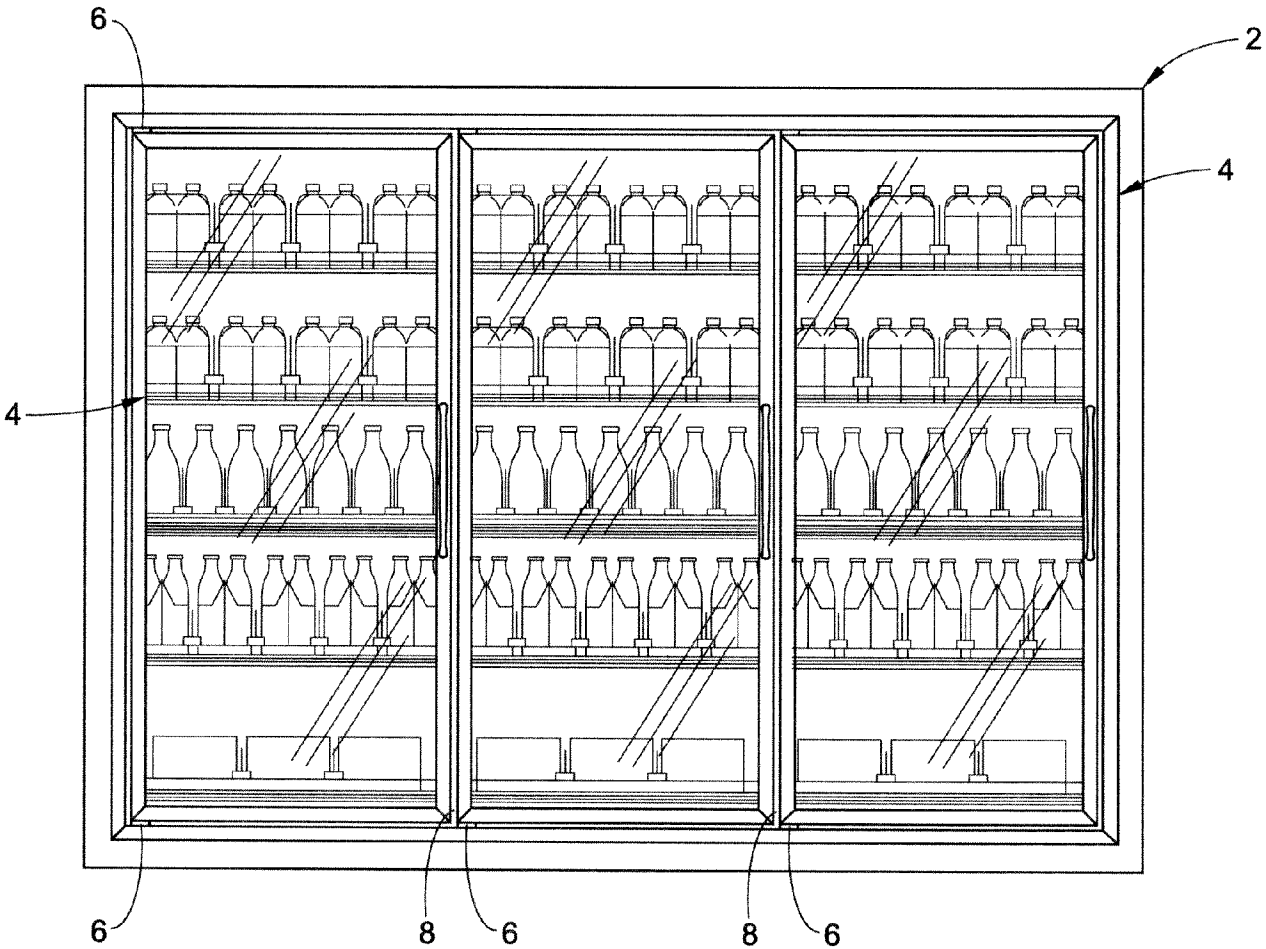
FIG. 1 is a front elevation view of a refrigerated display case that can be illuminated by the lamp disclosed in FIGS. 2 and 3.

With reference to FIG. 1, a typical refrigerated case 2 has doors 4 mounted to a front portion of the case each covering a door opening. The doors mount to the frame members via hinges 6. The doors include glass panels so that products inside the case are easily viewed without having to open the door. Mullions 8 provide door stops and points of attachment for the doors and hinges. The refrigerated enclosure 2 described can be a free-standing enclosure or a built-in enclosure. Furthermore, other refrigerated enclosures may include a different configuration, for example a refrigerated enclosure may not even include doors. The lighting systems described below can also be used with those types of refrigerated enclosures, as well as in a multitude of other cool applications.

Figure 2:
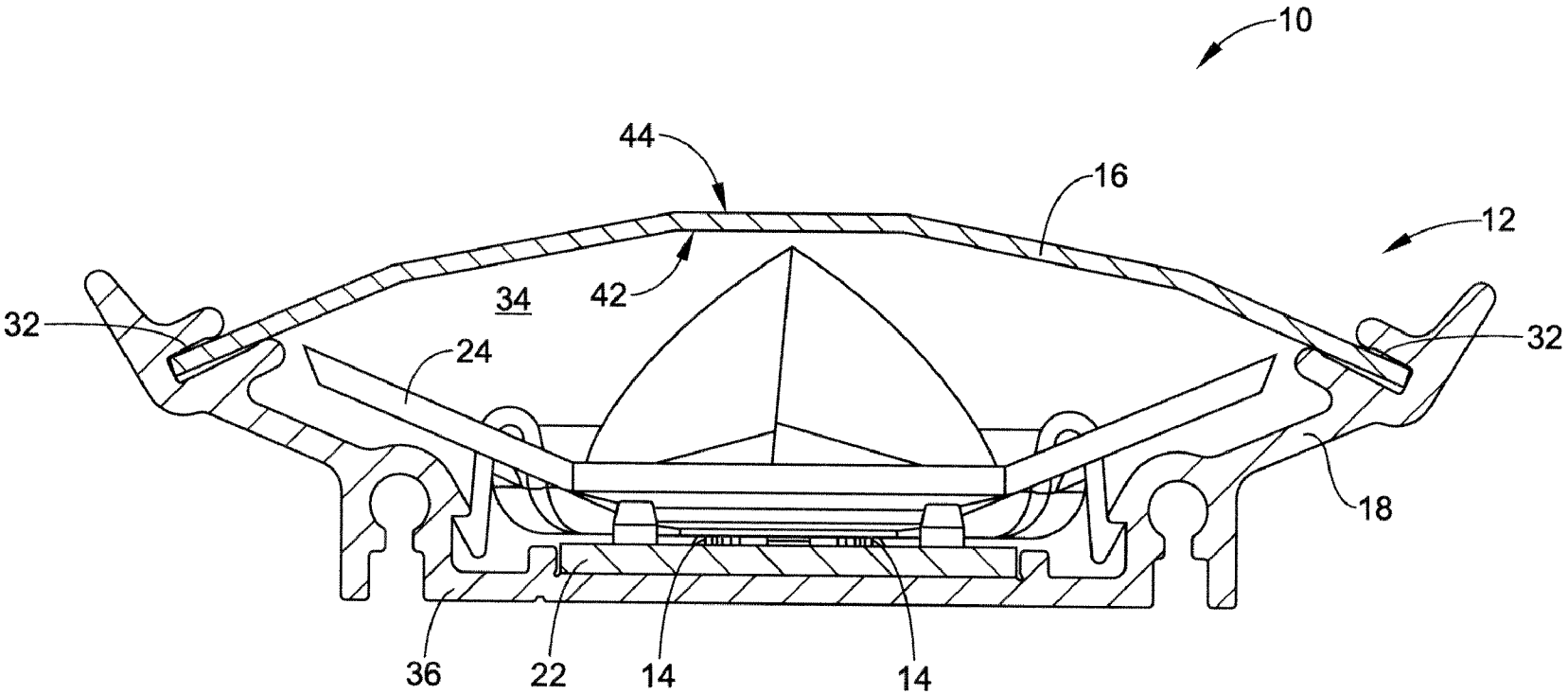
FIG. 2 is a cross-sectional view of a lamp.
Figure 3:
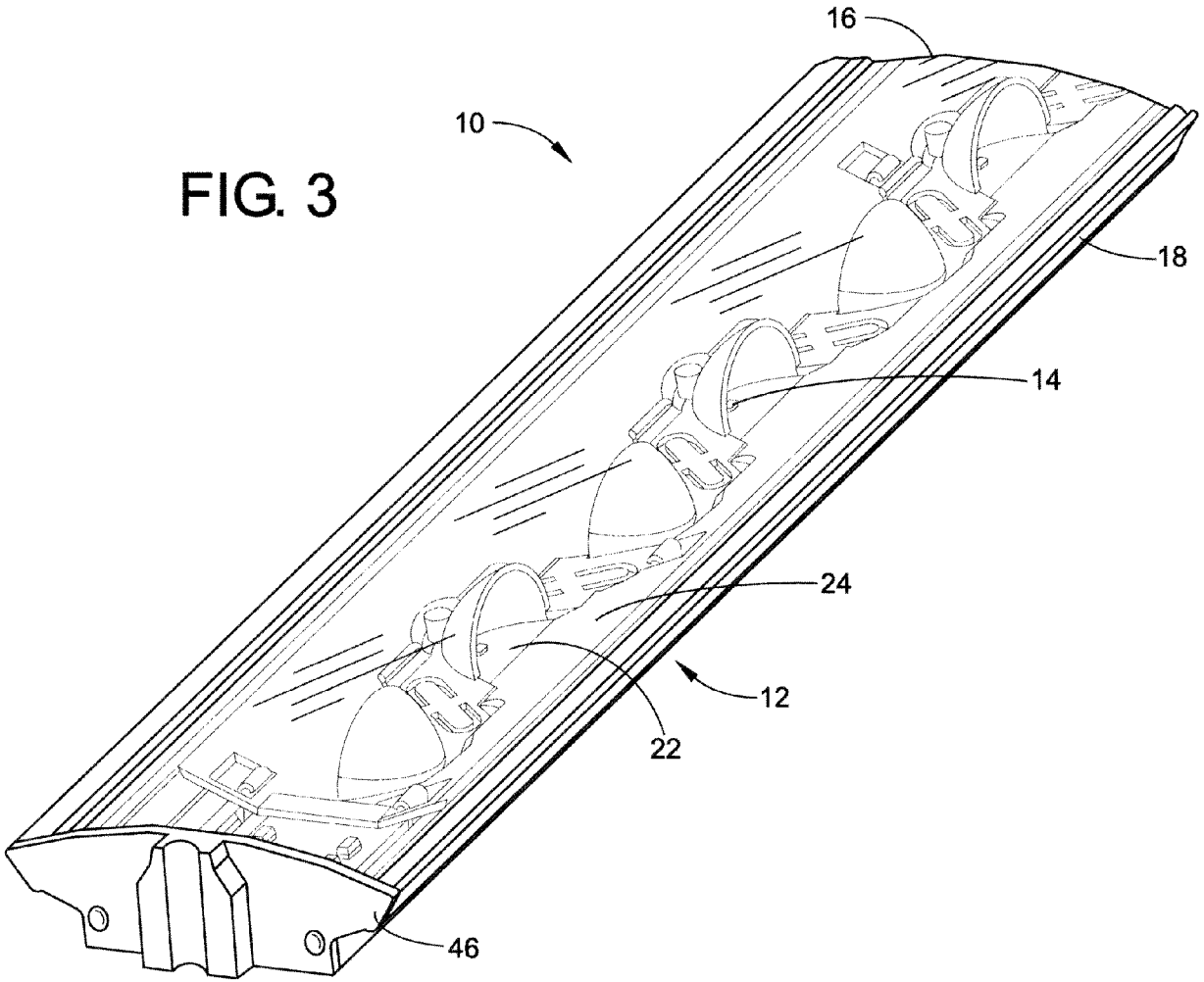
FIG. 3 is a perspective view of the lamp.

With reference to FIG. 2, a lamp 10 for use in a cool environment, for example a refrigerated enclosure, includes a housing 12 and an LED 14 disposed in the housing. The housing includes a translucent cover 16, which can also be a lens. In the depicted embodiment, the translucent cover 16 attaches to a heat sink 18 which also forms a part of the housing. The LED 14 is disposed in the housing with relation to the translucent cover 16 such that light from the LED passes through the cover onto products that are displayed in a refrigerated display case. The light may or may not be reflected by an optic or reflector prior to passing through the cover 16. In the embodiment shown in the figures an optic is provided; however, an optic is not required.

The lamp 10 is generally elongated and paralleliped in configuration. The lamp without the anti-fog material is more fully described in U.S. application No. 60/889,458, which is incorporated by reference in its entirety herein.

In addition to the housing 12 and the LEDs 14, the lamp 10 also includes a printed circuit board ("PCB") 22 and the optic 24, mentioned above. The LEDs 14 mount to the PCB 22 and the PCB is in electrical communication with a power source (not shown) for supplying power to the LEDs. The PCB is an FR4 two-sided printed circuit board having thermal vias. Circuitry is provided on the PCB in a manner that is known in the art. Alternatively, the PCB can be made from other materials such as metal clad or a metal core PCB.

The LEDs 14 are staggered on opposite sides of a central axis of the PCB 22 moving along the PCB and the direction parallel to the central axis. The LEDs 14 are driven by an external power supply that is connected to the PCB 22 in a known manner. The PCB 22 is held against the heat sink 18 by the optic 24. The PCB 22 is held in a channel 26 formed in the heat sink 18. From the LEDs 14 is heat conducted through the non-emitting side (lower) side of the LED 14 into the PCB 22, which conducts the heat into the heat sink 18. Very little heat is transmitted toward the translucent cover 16, especially as compared to a fluorescent lamp.

The lamp 10 can be easily altered so as not to include a PCB. For example, electricity can be delivered to the LEDs via a flex circuit, wires, a circuit ribbon or another known carrier of electricity. In such an instance and where the lamp includes a heat sink, the LEDs can be in thermal communication with the heat sink.

The translucent cover 16 is made from polyethylene tetraphthlate glycol (PETG) or polycarbonate (PC) flat sheet stock. The PETG or PC sheet stock is flatter and clearer than existing extruded lenses that are made to include the curve that is shown in FIG. 1. The extruded curved lenses are being used presently on LED lamps in cool environments. A clearer sheet stock translucent cover allows more light to escape the lamp 10 as compared to the extruded curved lens. Nevertheless, the translucent cover 16 can be molded, sheet stock, extruded or produced by another manufacturing process that is common to produce translucent covers and/or lenses. As such, the translucent cover can be made to have lensing capabilities.

Because the translucent cover 16 is made of a flat sheet stock material, the flat sheet stock is bent prior to insertion into retaining grooves 32 that are formed in the heat sink 18. Contact between the translucent cover 16 and the heat sink 18 is limited to the longitudinal edges of the translucent cover 16 that are retained in the channels 32 formed in the heat sink. A majority of the heat sink 18 is spaced from the translucent cover 16. As such, a void 34 is formed in the housing 12 generally between the translucent cover 16 and the heat sink 18. The air in the void insulates the heat in the heat sink from the central part of the lens, which can allow for the buildup of condensation and/or fog. Since a majority of the heat generated by the LED 14 is conducted into the heat sink 18, and more particularly into a lower base 36 (the horizontal section in FIG. 2, which includes portion in contact with PCB 22) of the heat sink 18, the translucent cover 16 is generally cooler and typically nearer the temperature of the air inside the refrigerated display case. When a consumer opens a door of the refrigerated display case, warmer more humid air located outside the display case flows into the display case and can collect on the cover 16.

An anti-fog film, which can also be referred to as an anti-film coating, can be disposed on at least one of the surfaces of the translucent cover 16. In the depicted embodiment, the anti-fog film is disposed on a light receiving surface 42 and a light emitting surface 44 of the translucent cover. The anti-fog film can be a two-sided polycarbonate film such as Lexan™ HP92AF film available from the General Electric Co. Other types of anti-fog films can also be used, for example the super hydrophilic coatings described in U.S. Published Patent Application No. 2007/0104922 A1, which is incorporated by reference in its entirety herein. Anti-fog films that exhibit similar properties to those shown in the table below can be good candidates for the anti-fog film.

| Property | ASTM Test Method | Units | Value | ISO Test Method | Units | Value |
|---|---|---|---|---|---|---|
| Physical | | | | | | |
| Density | ASTM D792 | slug/ft$^3$ | 2.3 | ISO 1183 | kg/m$^3$ | 1200 |
| Water Absorption, 24 hrs. | ASTM D570 | % change | 0.48 | ISO 62 | % change | 0.48 |
| Surface Energy (1$^{st}$ surface/2$^{nd}$ surface) | ASTM D5946-01 | – | 36/45 | | | |
| Surface Tension (1$^{st}$ surface/2$^{nd}$ surface) | Dyne Pens | Dyne | 38-40/32-34 | | | |
| Pencil Hardness (1$^{st}$ surface/2$^{nd}$ surface) | ASTM D3363 | – | hb-f/4h-5h | | | |
| Taber Abrasion | ASTM D1044 | delta Haze | 4/5 | | | |
| Bayer Abrasion (1$^{st}$ surface/2$^{nd}$ surface) | Colt Labs Test | Ratio | 0.9/12.13 | | | |
| Steel Wool Abrasion Haze Gain (1$^{st}$/2$^{nd}$) | Colt Labs Test | Haze Gain | 1.827/10.83 | | | |
| Steel Wool Abrasion Ratio Gain (1$^{st}$/2$^{nd}$) | Colt Labs Test | Ratio | 0.71/0.12 | | | |

In the depicted embodiment, both the light receiving surface 42 and the light emitting surface 44 are coated with the anti-fog film. The anti-fog coating, or anti-fog film, can be applied using a typical spray coating process or a typical die coating process, each of which are well known in the art. This is the case because the housing 12 is only moderately sealed. The housing includes end covers 46 (only one shown) that attach to the ends of both the translucent cover 16 and the heat sink 18. The connections between the end pieces, the cover and the heat sink allow for the ingress of air and water into the void 34. Accordingly, condensation can form on the light receiving surface 42 of the translucent cover 16.

A lamp that is useful for illuminating products found in a refrigerated display case has been described with particularity. The lamp is also useful in other cool environments. The lamp 10 can take many other configurations other than the specific embodiment disclosed. For example, the lamp can include a circular shaped or another shaped heat sink. The translucent cover can also take another configuration. The invention is not to be limited to only the embodiments that are described above. Instead, the invention is broadly defined by the appended claims and the equivalents thereof.

The invention claimed is:

1. A lamp comprising:

a housing including a translucent cover;

an LED disposed in the housing with relation to the translucent cover such that light from the LED passes through the cover; and an anti-fog film disposed on at least one of a light receiving surface and a light emitting surface of the translucent cover.

2. The lamp of claim 1, further comprising a heat sink in thermal communication with the LED, a majority of the heat sink being spaced from the translucent cover such that a void exists between the heat sink and the cover.

3. The lamp of claim 2, wherein the housing provides an enclosure surrounding the LED that allows for the ingress of air and water into the enclosure.

4. The lamp of claim 3, wherein the translucent cover is made from a flat sheet stock material.

5. The lamp of claim 4, wherein the translucent cover made from sheet stock material connects to and contacts the heat sink, the translucent cover being bent prior to connecting to the heat sink.

6. The lamp of claim 5, wherein the anti-fog film is disposed on both the light receiving surface and the light emitting surface.

7. The lamp of claim 6, wherein the translucent cover is made from polyethylene tetraphthalate glycol.

8. The lamp of claim 6, wherein the translucent cover is made from polycarbonate.

9. The lamp of claim 1, wherein the translucent cover is a molded or an extruded piece.

10. The lamp of claim 1, wherein the anti-fog film is a polycarbonate film having a water absorption value of about 0.48% change in 24 hours.

11. A refrigerated display case comprising:

a refrigerated enclosure having a door opening;

a door attached to the enclosure and covering the door opening for providing access to inside the enclosure;

a lamp connected to the enclosure for illuminating products stored within the enclosure, the lamp including a plurality of LEDs;

a heat sink in thermal communication with the LEDs, wherein the LEDs conduct heat into the heat sink;

a cover connected to the heat sink and disposed in relation to the LEDs so that light emitted from the LEDs passes through the cover; and an anti-fog material on or in the cover.

12. The display case of claim 11, wherein a majority of the heat sink is spaced from the cover.

13. The lamp of claim 12, wherein heat sink and the cover provide an enclosure surrounding the LED that allows for the ingress of air and water.

14. The lamp of claim 13, wherein the anti-fog film is disposed on both a light receiving surface and a light emitting surface of the cover.

15. The lamp of claim 11, wherein the translucent cover is made from a sheet stock material.

16. The lamp of claim 15, wherein the translucent cover is made from polyethylene tetraphthalate glycol.

17. The lamp of claim 15, wherein the translucent cover is made from polycarbonate.

18. The luminaire of claim 15, wherein the sheet stock material is flat.

19. The lamp of claim 11, wherein the anti-fog material comprises a film having a density of about 1200 $kg/m^3$.

20. A method for manufacturing a lamp for use in a cool environment, the method comprising:

placing an LED in a housing;

attaching a cover to the housing at a location so that light emitted from the LED passes through the cover, wherein the cover has been coated with an anti-fog material.

21. The method of claim 20, further comprising bending the cover prior to or during attaching the cover to the housing.

22. The method of claim 20, wherein attaching a cover further comprises attaching a cover that has been coated on at least two sides of the cover with an anti-fog material.

* * * * *